United States Patent [19]

Leufert et al.

[11] Patent Number: 4,840,581

[45] Date of Patent: Jun. 20, 1989

[54] CABLE JACKET STRAIN RELIEF ADAPTER ASSEMBLY

[75] Inventors: Walter P. Leufert, Harrisburg; David L. Miller, Landisville, both of Pa.

[73] Assignee: AMP Incorporated, Harrisburg, Pa.

[21] Appl. No.: 288,747

[22] Filed: Dec. 22, 1988

[51] Int. Cl.[4] ..... H01R 13/595

[52] U.S. Cl. ..... 439/472; 439/473

[58] Field of Search ..... 439/470–473, 439/449, 468, 460

[56] References Cited

U.S. PATENT DOCUMENTS

| | | | |
|---|---|---|---|
| 2,972,492 | 2/1961 | Mintz et al. | 439/470 |
| 3,739,318 | 6/1973 | Winter et al. | 439/472 |
| 3,781,765 | 12/1973 | Schleicher | 439/472 |
| 3,880,490 | 4/1975 | Belmont | 439/472 |
| 4,284,318 | 8/1981 | Wiley et al. | 439/472 |
| 4,421,376 | 12/1983 | Cosmos et al. | 439/461 |
| 4,634,206 | 1/1987 | Harting et al. | 439/449 |
| 4,761,145 | 8/1988 | Goto et al. | 439/469 |

FOREIGN PATENT DOCUMENTS 2203002A 10/1988 United Kingdom .

OTHER PUBLICATIONS

AMP Catalog No. 74–265, Revised 7–82, "High Density Rectangular Connectors", p. 17; AMP Incorporated, Harrisburg Pa.

AMP Catalog No. 73–204, Revised 6–83, "CPC Connectors", pp. 38, 40–42, 45, 53; AMP Incorporated, Harrisburg, Pa.

*Primary Examiner*—Gary F. Paumen

*Attorney, Agent, or Firm*—Anton P. Ness

[57] ABSTRACT

An adapter assembly is fastened to a preexisting electrical connector assembly having a pair of cover members defining the cable exit. The adapter assembly includes a pair of clamping members which clamp against the cable jacket for strain relief, and the clamping members are fastened to a mounting member which itself is mounted across the cable exit between inwardly facing surface portions of the cover members and secured by the fasteners which previously secured the cover members to each other. The adapter assembly enables an assured strain relief mechanism for a larger dimensioned cable than that for which the preexisting connector was intended. The mounting member can cooperate with the strain relief surfaces previously defined on the cover members at the cable exit to provide a strain relief slightly compressing the conductors arranged in two bundles passing on either side of the mounting member.

7 Claims, 5 Drawing Sheets

CABLE JACKET STRAIN RELIEF ADAPTER ASSEMBLY

FIELD OF THE INVENTION

The present invention relates to the field of electrical connectors and more particularly to strain relief mechanisms for cables.

BACKGROUND OF THE INVENTION

Electrical connectors are known for multiconductor cables wherein cover members of the connectors define a cable exit and are fastened together upon assembly to the cable to engage and grip the outer surfaces of the cable jacket for strain relief to protect the terminations of the individual conductor wires to the terminals within the connector housing. The cover members can be secured together allowing a limited range of heights so that variations in cable diameter within a similar limited range of diameters can be gripped by the same cover members. Where the cable jacket defines too large a diameter for the given range, strain relief may be attained to the plurality of conductor wires forwardly of the edge of the cable jacket, but this is not preferable. Another undesirable situation arises when the cable jacket diameter is within the range for which the connector was designed but at the lower end of the range, and it is desired to provide a means for providing increased cable gripping for improved strain relief.

It is desired to provide a means for a connector of existing design to establish strain relief of a cable jacket, in addition to utilizing the existing strain relief means of the connector for gripping the plurality of conductors.

It is also desired to provide a means for a connector of existing design to establish strain relief for cables at or beyond the limits of cable diameters for which the connector was designed.

SUMMARY OF THE INVENTION

An adapter assembly is able to be fastened to an existing connector at the cable exit thereof, to provide a cable jacket-engaging portion rearwardly of the connector cable exit. The adapter assembly includes a mounting section which extends across the cable exit between conductors of the cable, and having holes through which extend bolts of the connector cover member fastening system. A pair of flanges at respective ends of the mounting section extend rearwardly and include respective holes through which other additional bolts may extend. A pair of opposed hemispheric clamping members are mountable to the flanges by the additional bolts extending through respective holes at both ends of each of the clamping members placed adjacent the flanges. The clamping members have inner cable jacket-engaging surfaces and when assembled to the mounting section flanges will engage and clamp substantial portions of the cable jacket providing strain relief to the cable jacket. The conductors extend forwardly of the jacket end and extend in two bundles past and on both sides of the mounting section extending transversely across the cable exit and into the connector; the opposing arcuate surfaces of the cover members at the cable exit clamp the conductors against side surfaces of the mounting section, providing conductor strain relief.

It is an objective of the present invention to provide an adapter assembly able to be fastened to a connector of existing design, to provide a cable jacket-engaging means having a larger diameter than the cable exit defined by the connector's existing cover member surfaces.

It is also an objective to provide a portion of the adapter assembly with a section which cooperates with the existing connector cover members to provide improved strain relief for the conductors of the cable.

An embodiment of the present invention will now be described with reference to the accompanying drawings.

DETAILED DESCRIPTION OF THE PREFERRED EMBODIMENT

Figure 1:
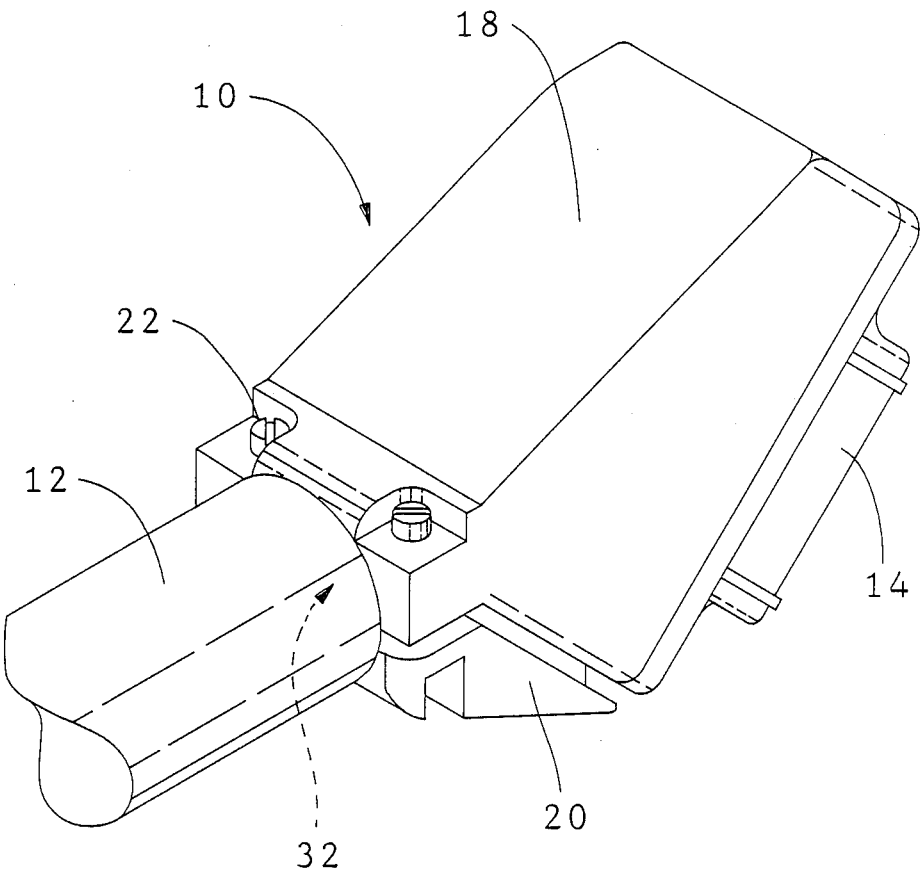
FIG. 1 PRIOR ART
FIGS. 1 and 2 illustrate the connector of the prior art without the adapter assembly of the present invention, assembled to a large diameter cable and exploded therefrom respectively.
Figure 2:
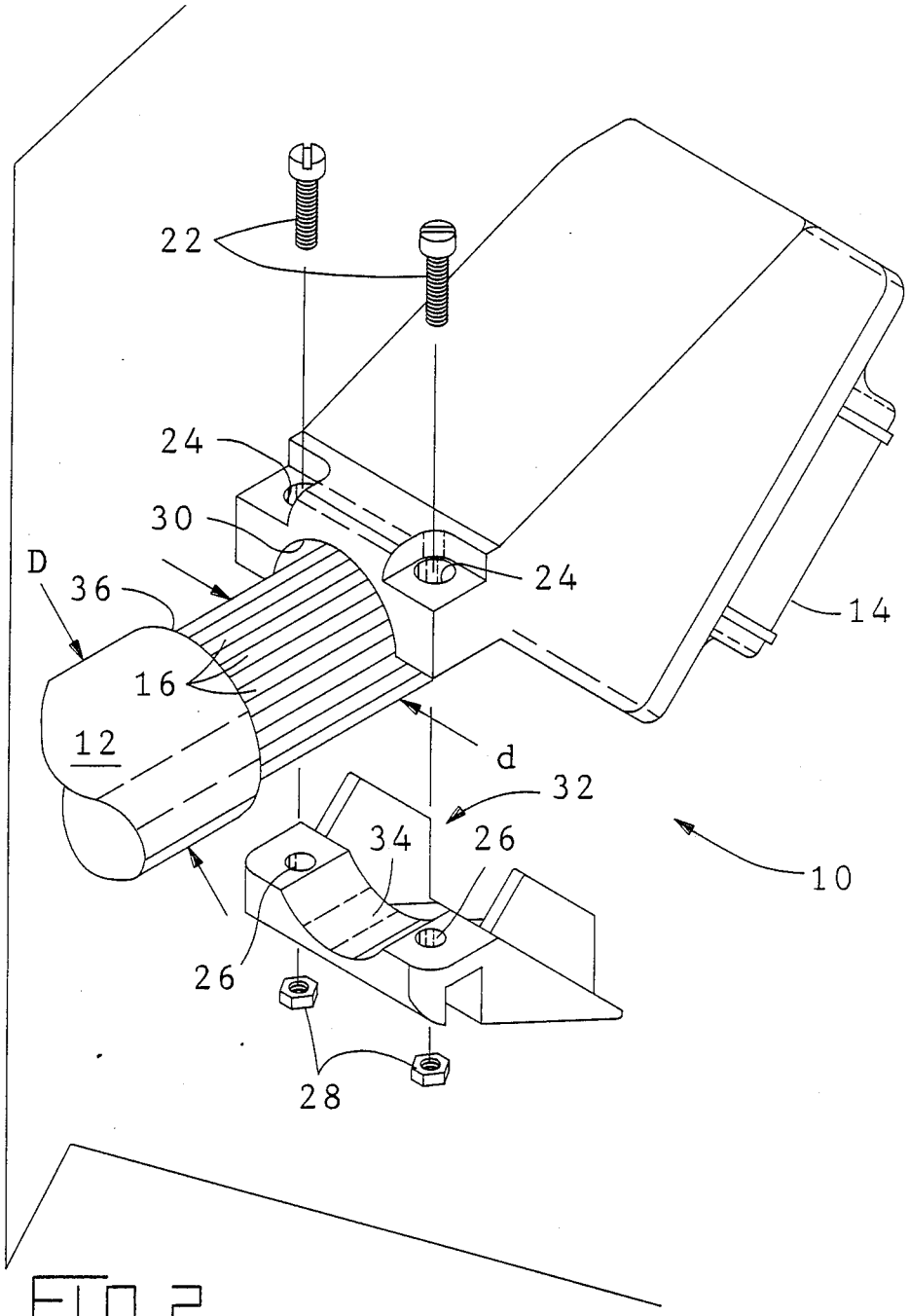
FIG. 2 PRIOR ART

FIGS. 1 and 2 illustrate a connector 10 of the prior art assembled to a cable 12 and having a connector housing 14 in which are housed terminals (not shown) terminated to individual conductors 16 of cable 12, a primary cover member 18 secured to connector housing 14, and secondary cover member 20 securable to primary cover member 18. Connector 10 is of the type sold under Part No. 204337-1 by AMP Incorporated, Harrisburg, Pa. Primary cover member 18 provides cover sections on three sides of the connector and conductors, while secondary cover member 20 provides a cover section for the fourth side. Bolts 22 extend through associated holes 24,26 of primary and secondary cover members 18,20 onto which are threaded nuts 28 to complete the assembly. Primary cover member 18 includes a strain relief surface 30 defining one side of a cable exit 32, and secondary cover member 20 includes a strain relief surface 34 opposing strain relief surface 30 and defining the other side of the cable exit. The cable exit can have a cross-sectional area which is adjustable to accept therethrough a cable having an outer diameter of up to 0.686 inches in the specific product, with the secondary cover member 20 having a shape which permits being slightly spaced away from primary cover member 18 and still maintain an appropriate covering structure.

The plurality of conductors 16 form a bundle having a general diameter d while the insulative outer cable jacket 36 has an outer diameter D . If jacket diameter D is larger than the diameter for which the existing connector was intended, then the cable jacket must be removed just rearwardly of the cable exit. Strain relief surfaces 30,34 then can engage and clamp the bundle of conductors 16 directly for a limited amount of strain relief but this arrangement is not entirely satisfactory; the clamping force on individual conductors should not be as great as would be preferred to be used directly with the cable jacket which is compressible, because damage could result to at least some of the conductors.

Figure 3:
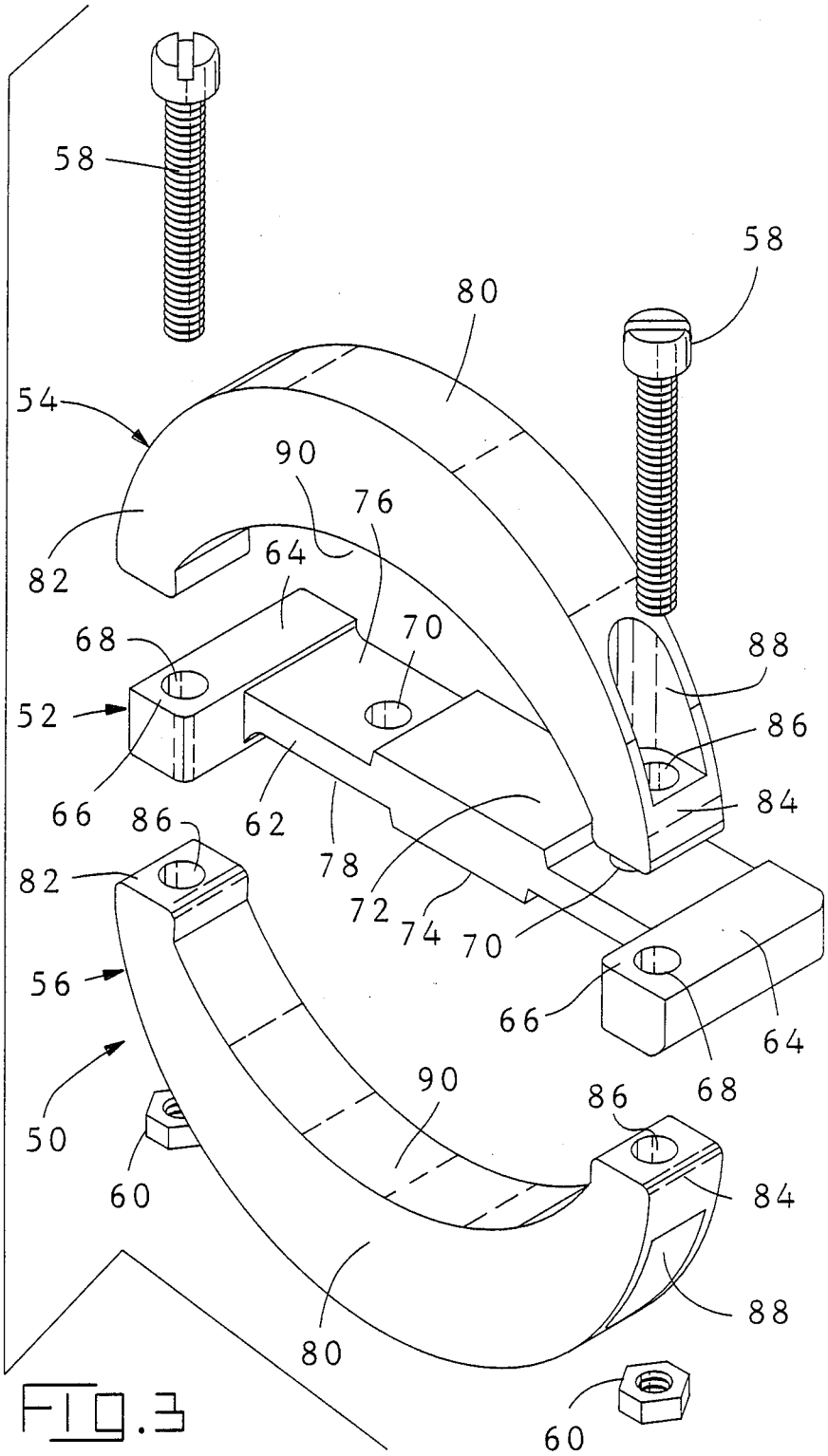
FIG. 3 is an exploded view of the adapter assembly of the present invention.
Figure 4:
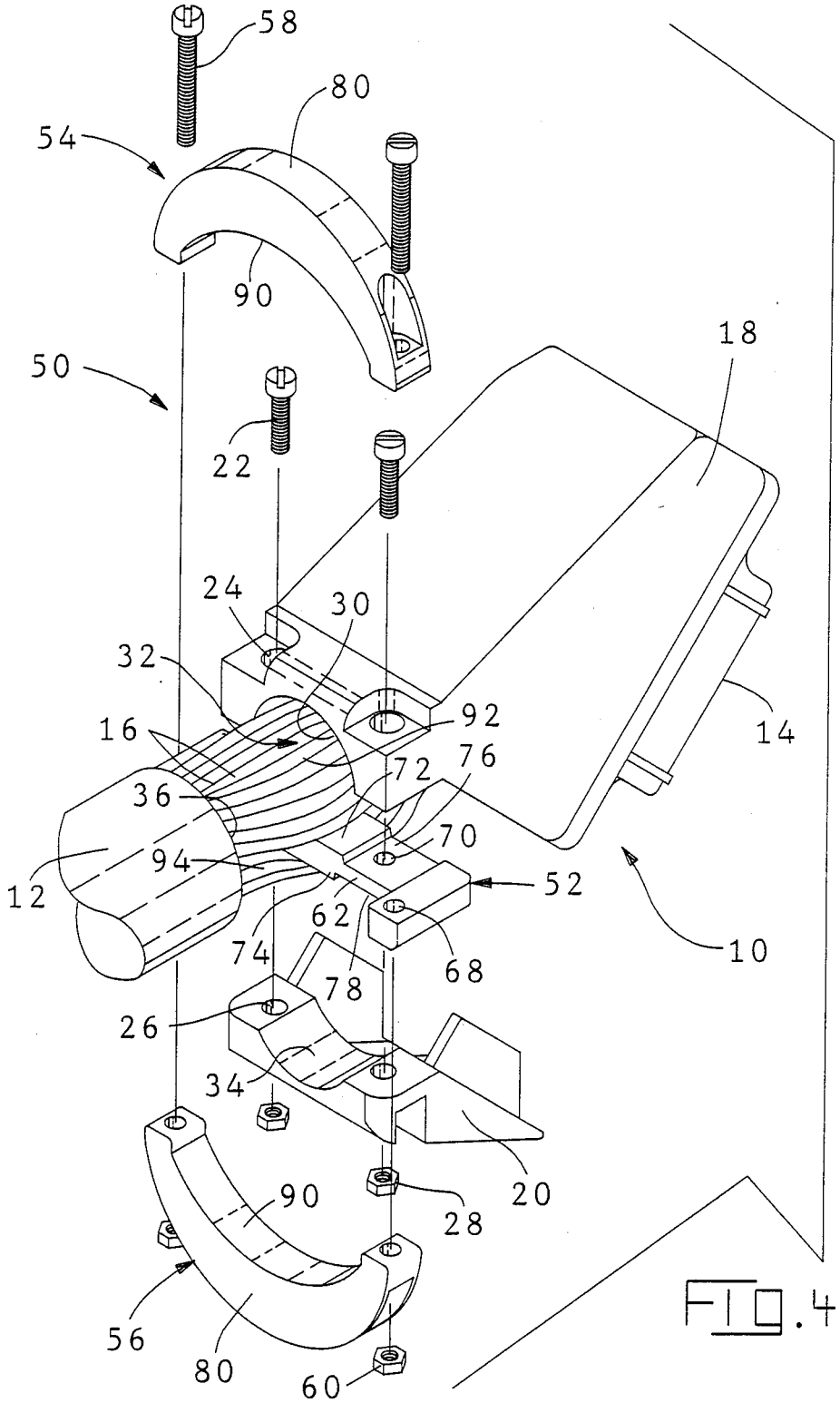
FIGS. 4 and 5 illustrate the assembly of the adapter of FIG. 3 to the prior art connector, and assembled thereto respectively.
Figure 5:
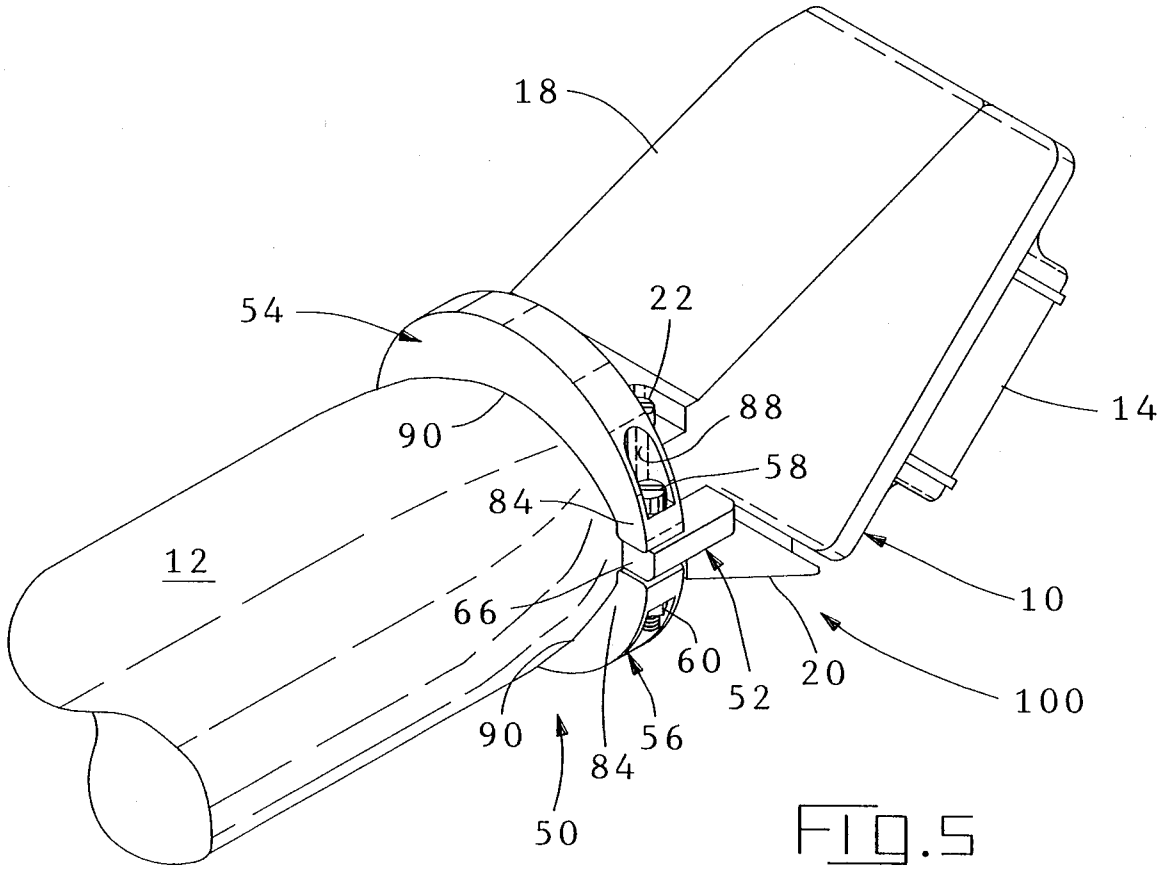

FIGS. 3 to 5 illustrate the present invention. In FIG. 3 adapter assembly 50 includes a mounting member 52, opposed clamping members 54,56 and fastener means such as bolts 58 and nuts 60. Mounting member 52 includes a transverse section 62 having flange sections 64 at opposed ends thereof extending in a common direction to flange ends 66 through which extend bolt-receiving apertures 68. Inwardly from flange sections 64 are holes 70 located to receive therethrough bolts 22 of connector 10 when mounted thereto, as shown in FIG. 4. In the embodiment shown, transverse section 62 includes raised lands 72,74 along side surfaces 76,78 intermediate holes 70. Clamping members 54,56 each include a clamping section 80 and end sections 82,84. Each end section includes a bolt-receiving aperture 86 alignable with a corresponding bolt-receiving aperture 68 of mounting member 52 during assembly of adapter assembly 50 to connector 10 and cable 12. Preferably the outer end of each bolt-receiving aperture 86 is disposed in a recess 88, so that the ends of bolts 58 are recessed within the general structure of adapter assembly 50, the bolt head disposed in one recess and the nut threaded onto the shank of the bolt disposed in the other recess. Each clamping section 80 defines an inwardly facing arcuate cable-engaging surface 90 between end sections 82,84.

In FIG. 4 adapter assembly 50 is shown being assembled to connector 10 and cable 12. Mounting member 52 is inserted through two bundle portions 92,94 of conductors 16 which are secured to connector housing 14 within primary cover member 18, until holes 70 are aligned with holes 24 of primary cover member 18 and holes 26 of secondary cover member 20. It is preferred that bundle portion 92 located between raised land 72 and cable-engaging surface 30 contain as many conductors 16, as can be disposed and slightly clamped between raised land 72 of mounting member 52 and cable-engaging surface 30 of primary cover member 18, and that fewer conductors 16 be contained in bundle portion 94 disposed and also clamped between raised land 74 and cable-engaging surface 34 of secondary cover member 20. The manner in which mounting member 52 is mounted between cover members 18,20 across cable exit 32 permits secondary cover member 20 to be spaced a slight distance from primary cover member 18 at least equal to the thickness of transverse section 62 of mounting member 52, and also permits cable-engaging surfaces 30,34 to engage and clamp the conductors of bundle portions 92,94 against raised lands 72,74 of mounting member 52 respectively to comprise a conductor strain relief.

Raised lands 72,74 are optional and can be utilized to extend toward now-opposing ones of cable-engaging surfaces 30 and 34 to actually reduce the effective cross-sectional area through which the conductors 16 extend at cable exit 32 to assure clamping of conductors 16. In fact, mounting member 52 need not engage any portion of either primary or secondary cover members 18,20 when adapter assembly 50 is fastened to connector 10 by bolts 22 and nuts 28, but instead engages only ones of conductors 16 of bundle portions 92,94 to assure conductor strain relief, if desired.

General cable strain relief is provided by cable-engaging surfaces 90 of clamping members 54,56 of adapter assembly 50 tightly clamping against and compressing the adjacent outer surfaces of cable jacket 36 when clamping members 54,56 are tightly fastened to flange ends 66 of mounting member 52 by bolts 58 and nuts 60, as shown in FIG. 5, defining a complete connector assembly 100 of the present invention. The adapter assembly of the present invention essentially allows products of existing design to be used with cables having diameters larger than the maximum diameter for which the produces was intended, and attain satisfactory strain relief directly to the cable jacket and optionally additional limited strain relief to the conductors, if desired.

Various modifications may be made to the present invention within the spirit of the invention and the scope of the claims.

What is claimed is:

1. An adapter assembly for being secured to a preexisting electrical connector assembly having first and second cover members securable together at a cable exit to define the cable exit for a multiconductor cable, the adapter assembly for providing improved cable strain relief when the electrical connector assembly including the adapter assembly is secured to the multiconductor cable, the adapter assembly comprising:

a mounting member and a pair of clamping members securable to said mounting member by securing means, said mounting member adapted to be mounted between facing portions of first and second cover members of the electrical connector assembly at a cable exit thereof, and said clamping members upon being secured to said mounting member and thereby secured to said electrical connector assembly engage and firmly clamp outer surface portions of an outer jacket of a multiconductor cable having conductors terminated to respective terminals within a housing of said electrical connector assembly.

2. An adapter assembly as set forth in claim 1 wherein said mounting member includes a transverse mounting section and flange sections at ends thereof extending outwardly and rearwardly from said electrical connector assembly, each said flange section including a flange end through which extends an aperture for receiving therethrough a shank of a respective fastener, and each said clamping member includes a clamping section engageable with said cable jacket and end sections including apertures alignable with said flange section apertures, whereby fasteners extend through respective sets of aligned apertures of associated e d sections of both said clamping members having said flange sections of said mounting member therebetween and clamp said clamping members against said cable jacket upon complete assembly.

3. An adapter assembly as set forth in claim 2 wherein each said clamping member is hemispheric and includes an arcuate cable-engaging inner surface.

4. An adapter assembly as set forth in claim 2 wherein said end sections of said clamping members include respective recesses extending outwardly from said apertures for receiving end portions of said fasteners.

5. An adapter assembly as set forth in claim 2 wherein said transverse mounting section extends across said cable exit and includes first and second side surfaces opposing inwardly facing surfaces of said first and second cover members respectively of said electrical connector assembly at said cable exit, and upon said conductors of said multiconductor cable terminated within said connector being arranged to extend through said cable exit, said conductors extend past one or the other of said first and second side surfaces of said transverse mounting section and said inwardly facing surfaces of said first and second cover members respectively, upon assembly of said mounting member to said first and second cover members.

6. An adapter assembly as set forth in claim 5 wherein said means securing said first and second cover members together comprise fasteners extending through aligned holes thereof, and said transverse mounting section includes apertures corresponding to said cover member holes for said cover-securing fasteners to extend therethrough upon assembly of said mounting member to said first and second cover members, and said first and second cover members when secured together with said transverse mounting section therebetween are spaced apart at least a distance equal to the thickness of said transverse mounting section.

7. An adapter assembly as set forth in claim 6 wherein said cable conductors are slightly compressed in two bundles between said first and second side surfaces of said transverse mounting section and said inwardly facing surfaces of said first and second cover members, defining a conductor strain relief.

* * * * *

UNITED STATES PATENT OFFICE

CERTIFICATE OF CORRECTION

Patent No. 4,840,581 Dated June 20, 1989

Inventor(s) Walter P. Leufert, David L. Miller

It is certified that error appears in the above-identified patent and that said Letters Patent is hereby corrected as shown below:

In column 4, line 41, claim 2, the "e d" should be "end".

Signed and Sealed this

Twenty-sixth Day of June, 1990

*Attest:*

HARRY F. MANBECK, JR.

*Attesting Officer*

*Commissioner of Patents and Trademarks*